US006705401B2

(12) United States Patent
Buckle et al.

(10) Patent No.: US 6,705,401 B2
(45) Date of Patent: Mar. 16, 2004

(54) PORTED SUBSEA WELLHEAD

(75) Inventors: Kevin G. Buckle, Tipperty by Ellon (GB); John H. Osborne, Ullapool Ross-Shire (GB); Bernard Humprey, Aberdeenshire (GB); Alan M. Clark, Aberdeen (GB); Alfred Massie, Aberdeen (GB)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 10/037,532

(22) Filed: Jan. 4, 2002

(65) Prior Publication Data

US 2003/0127229 A1 Jul. 10, 2003

(51) Int. Cl.[7] ..... E21B 33/14
(52) U.S. Cl. ..... 166/337; 166/346; 166/368
(58) Field of Search ..... 166/336, 337, 166/346, 348, 344, 368, 88.4, 95.1

(56) References Cited

U.S. PATENT DOCUMENTS

| | | | | |
|---|---|---|---|---|
| 5,366,017 A | | 11/1994 | Voss, Jr. | 166/368 |
| 5,544,707 A | | 8/1996 | Hopper et al. | 166/368 |
| 6,039,119 A | * | 3/2000 | Hopper et al. | 166/368 |
| 6,186,236 B1 | | 2/2001 | Cox | 166/384 |
| 6,360,822 B1 | * | 3/2002 | Robertson | 166/368 |
| 6,394,194 B1 | | 5/2002 | Queen et al. | |
| 2002/0117305 A1 | | 8/2002 | Calder et al. | |

OTHER PUBLICATIONS

U.S. patent application Ser. No. 10/315,717, Jennings et al.
U.S. patent application Ser. No. 10/305,558, Clark.
U.S. patent application Ser. No. 10/077,231, Calder et al., filed Aug. 29, 2002.

* cited by examiner

*Primary Examiner*—William Neuder
(74) *Attorney, Agent, or Firm*—Bracewell & Patterson, L.L.P.

(57) ABSTRACT

A susbsea well has communication passages to enable annulus pressure surrounding inner and intermediate strings of casings to be monitored at the surface. The passages both have outlets that allow communication to the tree assembly for monitoring. In one embodiment, the passage outlets are located in the bore of the high pressure well head housing and communicates to the tree assembly along an isolation sleeve. In another embodiment, the passage outlets are located on the exterior of the high pressure wellhead housing and communicate through a flying lead coming down from the tree. In another embodiment, the passage outlets are located on the exterior of the high pressure wellhead housing and communicate to an upward facing connection which is stabbed with a downward facing connection coming down from the tree.

19 Claims, 4 Drawing Sheets

PORTED SUBSEA WELLHEAD

FIELD OF THE INVENTION

This invention relates in general to offshore drilling and production equipment, and in particular to a subsea well system for monitoring the pressure in a non-producing string of casing through the completion system.

DESCRIPTION OF THE RELATED ART

A subsea well that is capable of producing oil or gas will have a conductor housing secured to a string of conductor pipe which extends a first depth into the well. A wellhead housing lands in the conductor housing. The wellhead housing is secured to an outer or first string of casing, which extends through the conductor to a deeper depth into the well. Depending on the particular conditions of the geological strata above the target zone (typically, either an oil or gas producing zone or a fluid injection zone), one or more additional casing strings will extend through the outer string of casing to increasing depths in the well until the well is cased to the final depth. Each string of casing is supported at the upper end by a casing hanger. The casing hanger lands in and is supported by the wellhead.

In some shallow wells and in some fluid injection wells, only one string of casing is set within the outer casing. Where only one string of casing is set within the outer casing, only one casing hanger, the production casing hanger, is landed in the wellhead housing.

The more typical case is where multiple strings of casing are suspended within the wellhead housing to achieve the structural support for the well to the depth of the target zone. Where multiple strings of casing hangers are landed in the wellhead housing, each casing hanger is above the previous one in the wellhead housing. Between each casing hanger and the wellhead housing, a casing hanger packoff is set to isolate each annular space between strings of casing. The last string of casing extends into the well to the final depth, this being the production casing. The strings of casing between the outer casing and the production casing are intermediate casing strings.

When drilling and running strings of casing in the well, it is critical that the operator maintains pressure control of the well. This is accomplished by establishing a column of fluid with predetermined fluid density inside the well. During drilling operations, this fluid is circulated down into the well through the inside of the drillstring out the bottom of the drillstring and back to the surface. This column of density-controlled fluid balances the downhole pressure in the well. When setting casing, the casing is run into the pressure balanced well. A blowout preventer system is employed during drilling and running strings of casing in the well as a further safety system to insure that the operator maintains pressure control of the well. The blowout preventer system is located above the wellhead housing by running it on drilling riser to the wellhead housing.

When each string of casing hanger is suspended in the wellhead housing, a cement slurry is flowed through the inside of the casing, out of the bottom of the casing, and back up the outside of the casing to a predetermined point. In a subsea well capable of producing oil or gas, the production fluids flow through perforations made in the production casing at the producing zone. A string of tubing extends to the producing zone within the production casing to provide a pressure controlled conduit through which the well fluids are produced. At some point above the producing zone, a packer seals the space between the production casing and the tubing to ensure that the well fluids flow through the tubing to the surface. The tubing is supported by a tubing hanger assembly that lands and locks above the production casing hanger, either in the wellhead housing, in a tubing hanger spool, or in a horizontal or spool tree, as described below.

Subsea wells capable of producing oil or gas can be completed with various arrangements of the production control valves in an assembly generally known as a tree. For wells completed with a conventional tree, the tubing hanger assembly lands in the wellhead housing above the production casing hanger. Alternatively, the tubing hanger assembly lands in a tubing hanger spool that is itself landed and locked to the wellhead housing. For wells completed with a horizontal or spool tree, the horizontal tree lands and seals on the wellhead housing. A tubing hanger assembly lands and seals in the horizontal tree.

The tubing hanger assembly in conventional trees has a flow passage for communication with the annulus surrounding the tubing. A tubing annulus bypass extends around the tubing hanger in horizontal trees. These passages allow for communication between the interior of the production casing and the interior of the tubing. Virtually all producing wells are capable of monitoring pressure in the annulus flow passage between the interior of the production casing and the exterior of the tubing.

A sealed annulus locates between the production casing and the next larger string of casing. Normally there should be no pressure in the annulus between the production casing and the next larger string of casing because the annular space between the production casing and the next larger string of casing is ordinarily cemented at its lower end and sealed with a packoff at the production casing hanger end. If pressure within this annulus increases, it would indicate that a leak exists in one of the strings of casing. The leak could be from several places. Regardless of where the leak is coming from, pressure build up in the annulus between the production casing and the next larger string of casing could collapse a portion of the production casing, compromising the structural and pressure integrity of the well.

For this reason, operators monitor the pressure in the annulus between the production casing and the next larger string of casing in land-based or above water wells. Monitoring production casing annulus pressure in a subsea well is more difficult because of lack of access to the wellhead housing below the production casing hanger packoff. Different methods have been proposed for monitoring the annulus pressure between the production casing and the next larger casing in subsea wells. However, most subsea wells do not have any ability to monitor casing annulus pressure.

SUMMARY OF THE INVENTION

In a subsea well with a tree assembly including either a tubing spool or a horizontal tree, the production casing annulus pressure and an intermediate casing annulus pressure are monitored through communication passages located in the high pressure wellhead housing. In the first embodiment, communication passages for communicating production casing annulus and intermediate casing annulus pressures extend into and up the high pressure wellhead housing, both opening on the inner surface of the high pressure wellhead housing above the lockdown hanger for the production tubing. Valves prevent the annulus pressures from communicating before the tree assembly is landed on the high pressure wellhead housing. The tree assembly has an isolation sleeve that seals to the inside of the wellhead housing below the outlets for the communication passages. After the tree assembly is landed, the valves are opened and the annulus pressures communicate through their respective passageways to the isolation sleeve, and then up to the tree assembly where the pressures are monitored.

In a second embodiment, communication passages for communicating the production casing annulus and the intermediate casing annulus pressures both extend from the inner surface of the high pressure wellhead housing to the exterior surface of the high pressure wellhead housing. Valves prevent the pressures from communicating before the tree assembly is landed. The tree assembly has a flying lead, which has connections that connect to both the passageway outlet for communicating the production casing annulus pressure and the passageway outlet for communicating the intermediate casing annulus pressure. The connections from the flying lead are attached to the outlets for communicating the annulus pressures. After connecting the flying lead connections from the flying lead extending down from the tree assembly, the valves are opened to allow communication of the production casing and intermediate casing annulus pressures through the passageways to the tree assembly for monitoring.

The third embodiment, the production casing annulus pressure is monitored. In the third embodiment, the annulus pressure communicates up the production casing housing to a passageway in the high pressure wellhead housing. The passageway extends from the inner surface of the high pressure wellhead housing to the exterior surface of the wellhead housing. In this embodiment, the wellhead has a guide base for aligning equipment as it is landed on the wellhead. High pressure wellhead housing has a guide frame attached to its outer surface that was guided to the wellhead along guide posts extending from the guide base. Mounted on the guide frame is a valve that connects to the passageway communicating the production casing annulus pressure. The valve prevents communication while the tree assembly is not attached. An extension tube extends from the valve and connects to an upward facing connection that is also mounted on the guide frame. A tree assembly has a downward facing connection, and when the tree lands on the wellhead housing, the connections are connected. When the valve is opened, the production casing annulus pressure communicates up the production casing, through the passageway in the high pressure housing, through the open valve, through the extension tube, and through the connected connections to the tree assembly for monitoring.

DETAILED DESCRIPTION OF PREFERRED EMBODIMENT

Figure 1:
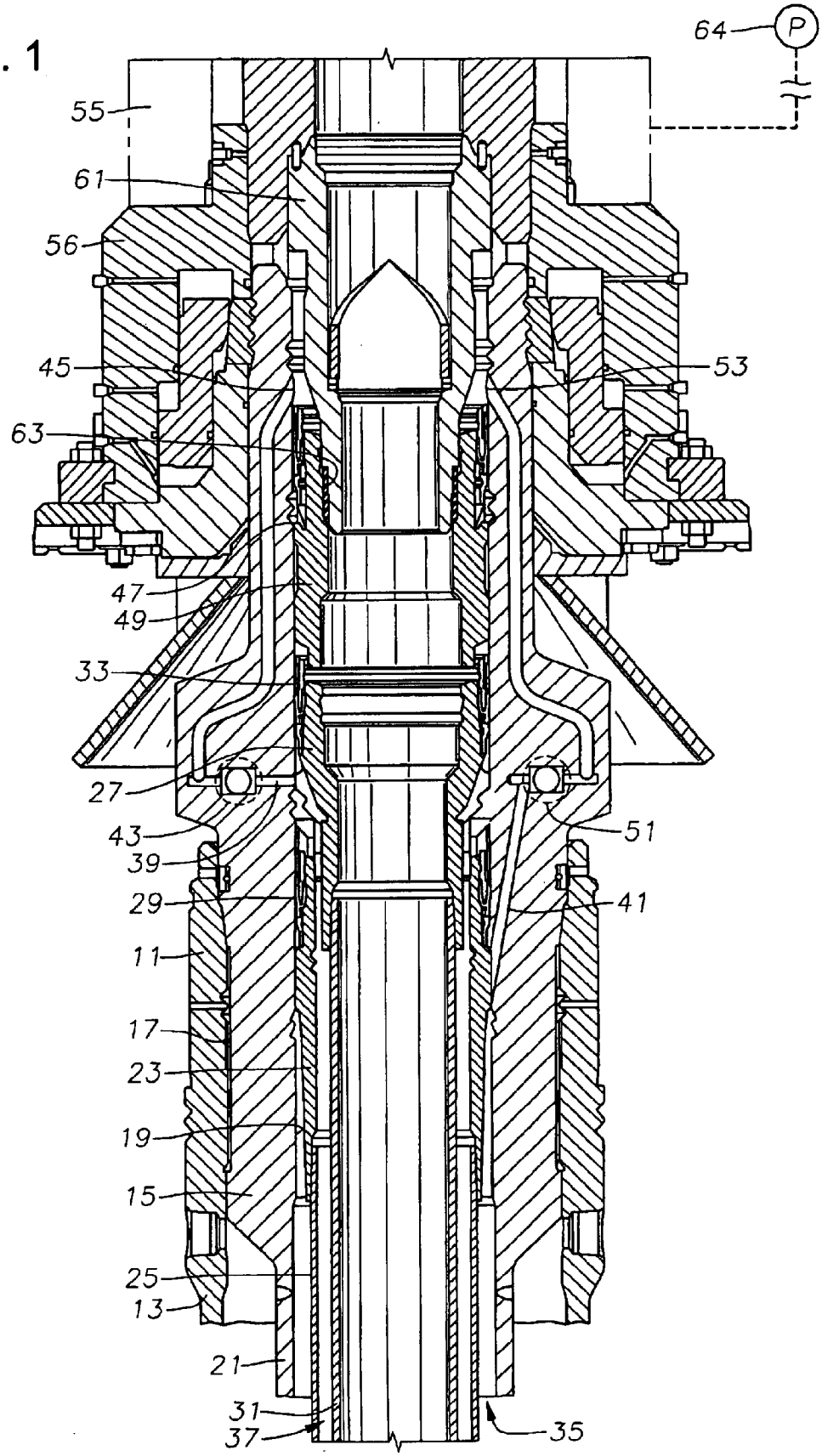
FIG. 1 is an overall sectional view of an upper portion of a wellhead assembly in accordance with this invention.

Referring to FIG. 1, one configuration for the subsea wellhead assembly includes a low pressure wellhead housing or conductor housing 11, which will locate at the sea floor. Low pressure wellhead housing 11 is a large tubular member that is secured to a string of conductor pipe 13. Conductor pipe 13 extends to a first depth into the well.

A high pressure wellhead housing 15 lands in the low pressure wellhead housing 11. High pressure wellhead housing 15 is a high pressure tubular member having an exterior surface 17 and an interior surface 19. High pressure wellhead housing 15 secures to a first string of casing 21, which extends through the conductor pipe 13 to a deeper depth into the well. Normally, the first string of casing 21 is cemented in place.

An intermediate casing hanger 23 and intermediate casing 25 are installed in high pressure wellhead housing 15 in the first string of casing 21. Intermediate casing hanger 23 lands on a lower shoulder in the interior surface of high pressure wellhead housing 15. Intermediate casing hanger 23 is sealed by an intermediate casing hanger packoff 29 to interior surface 19 of high pressure wellhead housing 15. Intermediate casing hanger 23 secures to a string of intermediate casing 25, which is cemented in place.

Production casing hanger 27 having an interior surface and an exterior surface lands on a shoulder on intermediate casing hanger 23. Production casing hanger 27 is sealed by a production casing hanger packoff 33 to interior surface 19 of high pressure wellhead housing 15. Production casing hanger 27 secures to production casing 31. Production casing 31 extends through intermediate string of casing 25 to a final depth of the well. Production casing 31 is cemented in place.

An intermediate casing annulus 35 exists in the space surrounding intermediate casing 25. Intermediate casing annulus 35 also surrounds intermediate casing hanger 23 up to intermediate casing hanger packoff 29. A production casing annulus 37 exists in the space surrounding production casing 31. Production casing annulus 37 also surrounds production casing hanger 27 up to production casing hanger packoff 33. Normally, there would be low pressure in intermediate casing annulus 35 and production casing annulus 37. Only a lower portion of production casing 31 is exposed to well pressure, and this exposure is through perforations (not shown). Cement in annulus 37 blocks communication upward of formation pressure from the perforations. Formation pressure may exist in production casing annulus 37 only when a leak occurs.

A production casing communication passageway 39 has a lower inlet in the bore 19 of high pressure wellhead housing 15. Passageway 39 is shown schematically and would not have the curves shown in FIG. 1 in actual production. Passageway 39 begins above intermediate casing packoff 29 and below production casing packoff 33. Passageway 39 connects with production casing valve 43, which when closed, prevents communication with production casing annulus 37. Preferably valve 43 is opened and closed by a remote operated vehicle ("ROV"). Passageway 39 extends upwardly after passing through valve 43, through high pressure wellhead housing 15 and ends at a production passage outlet 45 on interior surface 19 of high pressure wellhead housing 15. Production passage outlet 45 is located above lockdown hanger packoff 47 of lockdown hanger 49. Lockdown hanger 49 is optional. Passageway 39 allows fluid communication between production casing annulus 37 and interior surface 19 of high pressure wellhead 15.

An intermediate casing communication passageway 41 (schematically shown) extends at an upward angle into high pressure wellhead 15 from interior surface 19 from below intermediate casing packoff 29. Intermediate passageway 41 connects with intermediate casing valve 51, which blocks communication through passageway 41 when closed. Preferably valve 51 is ROV actuated. Intermediate passageway 41 extends upwardly after passing through intermediate valve 51, through high pressure wellhead housing 15 and ends at an intermediate passage outlet 53 on interior surface 19 of high pressure wellhead housing 15. Intermediate passage outlet 53 is located above lockdown hanger packoff 47 of lockdown hanger 49. Intermediate passage 41 allows fluid communication between intermediate casing annulus 35 and interior surface 19 of high pressure wellhead 15.

Communication from intermediate casing annulus 35 to intermediate passageway outlet 53 is not desired before a tree assembly 55 is installed on top of high pressure wellhead housing 15. Therefore, intermediate valve 51 prevents the annulus pressure from communicating to intermediate passageway outlet 53. Communication from production casing annulus 37 to production passageway outlet 45 is also not desired before a tree assembly 55 is installed on top of high pressure wellhead housing 15. Therefore, production valve 43 prevents the annulus pressure from communicating to production passageway outlet 45.

An isolation sleeve 61, mounted to the base of tree assembly 55, sealingly engages and attaches to interior surface of lockdown hanger 49 when tree assembly 55 is lands on the well. Tree assembly 55 has a connector 56 that secures to wellhead housing 15. Isolation sleeve packoff 63 seals isolation sleeve 61 to the interior surface lockdown hanger 49 so that there is a seal below production passageway outlet 45, and below intermediate passageway outlet 53. After tree assembly 55 is installed, valves 43 and 51 can open, therefore allowing the annular pressures from production casing annulus 37 and from intermediate casing annulus 35 to communicate to outlets 45 and 53, up the outer surface of isolation sleeve 61 to tree assembly 55, where the pressures are monitored and communicated by a control umbilical to a gauge 64 at the surface.

In operation of the FIG. 1 embodiment, the well will be drilled and cased as shown in FIG. 1. To do so, low pressure wellhead housing 11 with string of conductor pipe 13 is landed and cemented into the well to certain depth. High pressure wellhead housing 15 with first string of casing 21 from high pressure wellhead 15 is then landed and cemented into the well at a deeper depth. An intermediate hanger 23 with intermediate casing 25 extending below is landed and cemented into the well. Intermediate hanger packoff 29 sealingly connects intermediate hanger 23 to interior surface 19 of high pressure wellhead housing 15. Intermediate casing annulus 35 surrounds intermediate casing 25 after intermediate casing 25 is cemented into place. The pressure of intermediate casing annulus 35 communicates up the outside surface of intermediate casing 25, along the outside surface of intermediate casing hanger 23. Intermediate hanger 23 is sealingly fixed to interior surface 19 of high pressure wellhead housing 15 so intermediate annulus 35 pressure must communicate into intermediate passageway 41. Intermediate valve 51 prevents the pressure from communicating further until tree assembly 55 is landed. Production hanger 27 with production casing 31, extending down to production depth, is landed and cemented into the well. Production hanger packoff 33 sealingly connects production hanger 27 to interior surface 19 of high pressure wellhead housing 15. Production casing annulus 37 surrounds production casing 31 after production casing 31 is cemented into place. The pressure of production casing annulus 37 communicates up the outside surface of production casing 31, along the outside surface of production casing hanger 27. Production hanger packoff 33 sealingly fixes production hanger 27 to interior surface 19 of high pressure wellhead housing 15 so production annulus 37 pressure must communicate into production passageway 39. Annulus valve 43 prevents the pressure from communicating further until tree assembly 55 is landed. Similarly, any pressure from casing annulus 35 communicates through passage 41 up to a closed valve 51.

Lockdown hanger 49 with production tubing (not shown) is landed into the well, such that lockdown hanger packoff seals 47 sealingly engage lockdown hanger 49 to interior surface 19 of high pressure wellhead housing 15. Tree assembly 55 lands into the well such that isolation sleeve 61 stabs into and sealingly engages to the interior surface of lockdown hanger 49. Valves 43 and 51 are opened, preferably by a remotely operated vehicle. The pressure from intermediate casing annulus 35 communicates up through intermediate passageway 41 to intermediate passageway outlet 53 on interior surface 19 of high pressure housing 15. Isolation sleeve packoff 63 and lockdown hanger packoff 47, which are located below intermediate passageway outlet 53, force the pressure from intermediate casing annulus 35 to communicate up the outer surface of isolation sleeve 61 to tree assembly 55 for monitoring. The pressure from production casing annulus 37 communicates upwardly through production passageway 39 to production passageway outlet 45 on interior surface 19 of high pressure housing 15. Isolation sleeve packoff 63 and lockdown hanger packoff 47, which are located below production passageway outlet 45, force the pressure from production casing annulus 37 to communicate up the outer surface of isolation sleeve 61 to tree assembly 55 for monitoring. The outlets 45 and 53 lead to the same annular space around isolation sleeve 61, thus commingled and are monitored by gauge 64.

Figure 2:
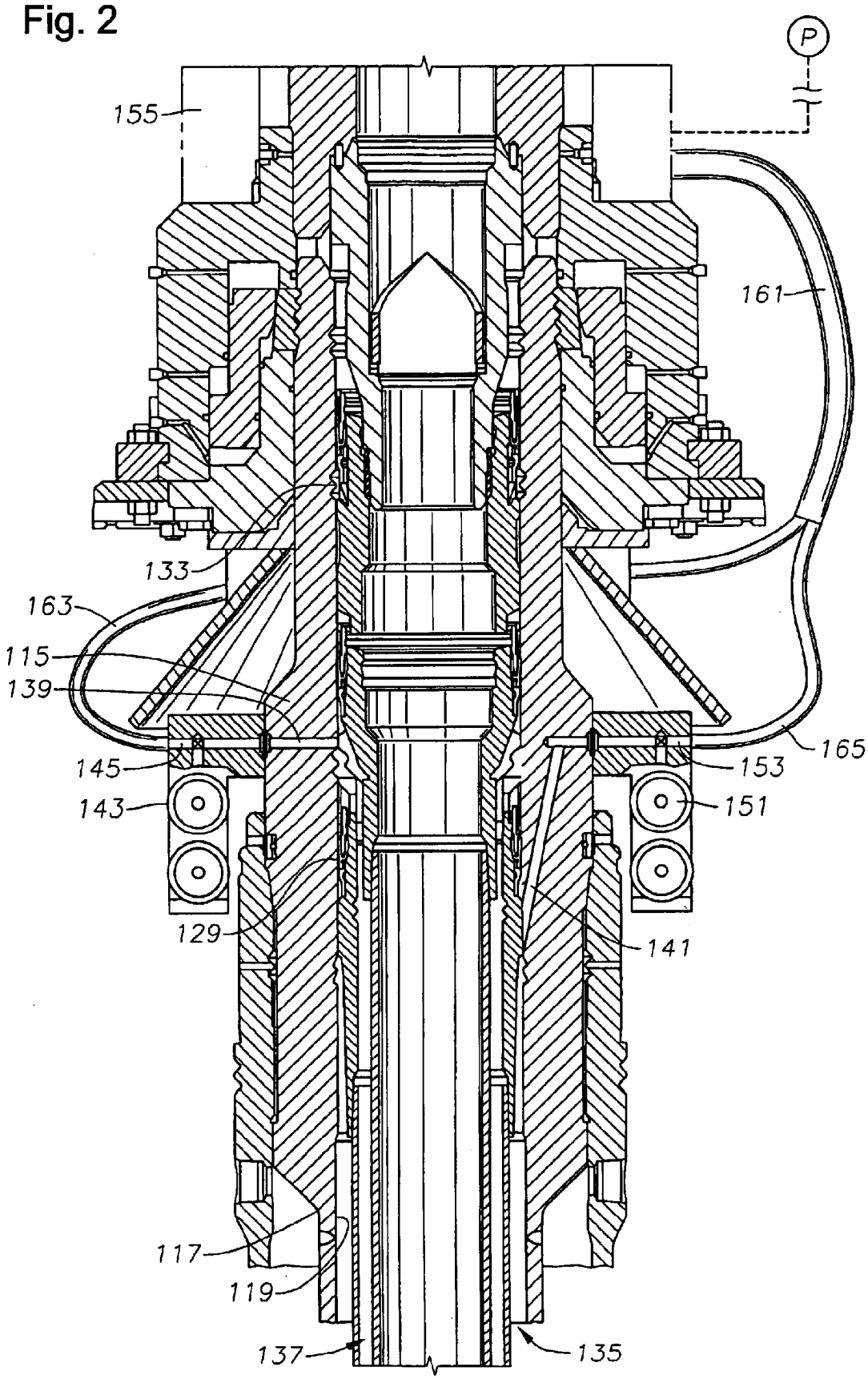
FIG. 2 is an overall sectional view of an upper portion of wellhead assembly in accordance with a second embodiment of this invention.

FIG. 2 shows a second embodiment of the well assembly. Referring to FIG. 2, a production casing annulus passageway 139 extends laterally through high pressure wellhead housing 115 from interior surface 119 towards exterior surface 117. Production passageway 139 begins above intermediate casing hanger packoff 129 and below production hanger casing packoff 133. Production passageway 139 connects with production casing valve 143. Annulus valve 143 prevents pressure communication of production casing annulus 137 while closed. Production passageway 139 continues after annulus valve 143 to a production passageway outlet 145 located on exterior surface 117 of high pressure wellhead housing 115.

An intermediate casing annulus passageway 141 extends laterally through high pressure wellhead housing 115 from interior surface 119 towards exterior surface 117. Intermediate passageway 141 begins below intermediate casing hanger packoff 129. Intermediate passageway 141 connects with intermediate casing valve 151. Intermediate valve 151 prevents pressure communication of intermediate casing annulus 135 while closed. Intermediate passageway 141 continues after intermediate valve 151 to a intermediate passageway outlet 153 located on exterior surface 117 of high pressure wellhead housing 115.

A tree assembly 155 having a flying lead 161 extending down from tree assembly, lands on high pressure wellhead housing 115. Flying lead 161 has a flexible tubing 163 connecting with production passageway outlet 145 so that the pressure of production casing annulus 137 communicates from production passageway 139 to tree assembly 155 for monitoring, when production annulus valve 143 is open. Flying lead 161 also has an intermediate casing annulus tubing 165 connecting with intermediate passageway outlet 153, so that the pressure from intermediate casing annulus 135 communicates from intermediate passageway 141 to tree assembly 155 for monitoring, when intermediate valve 151 is open. In this embodiment, the pressures from passageways 139 and 141 are not commingled.

In operation, the well will be drilled and cased in the second embodiment as shown in FIG. 2. After tree assembly 155 lands on wellhead housing 115, an ROV will connect flying lead tubing 163 to outlet 145 of casing annulus passageway 139. The ROV connects flying lead tubing 165 to intermediate passageway outlet 153 on high pressure housing exterior surface 117. Production passageway valve 143 and intermediate passageway valve 151 are both opened by the ROV. The production annulus pressure from production passageway 139 communicates through production valve 143, through flying lead production tubing 163, through flying lead 161 to tree assembly 155 for monitoring. The intermediate annulus pressure from intermediate passageway 141 communicates through intermediate valve 151, through flying lead intermediate tubing 165, through flying lead 161 to tree assembly 155 for monitoring.

Figure 3:
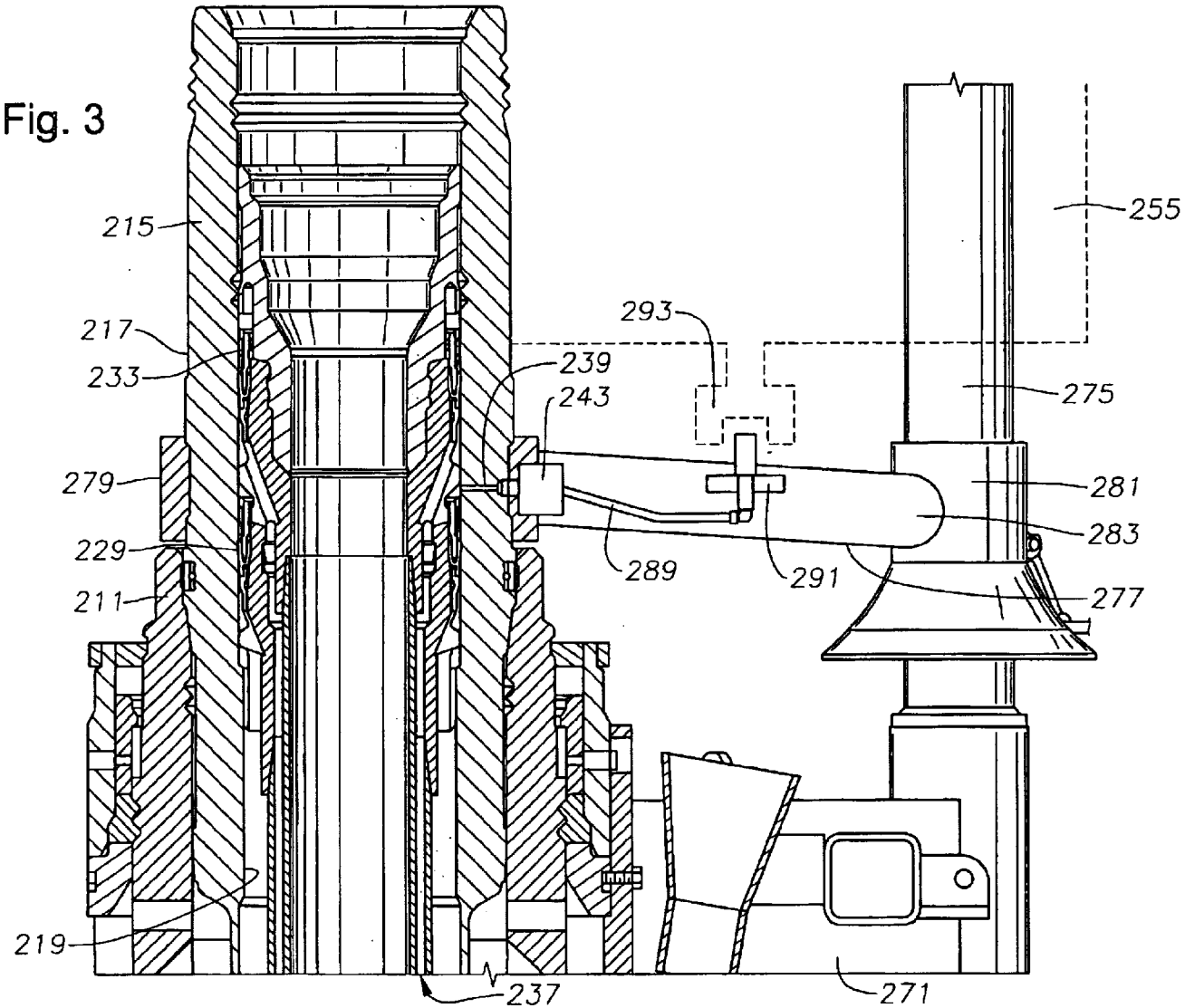
FIG. 3 is an overall sectional view of an upper portion of wellhead assembly in accordance with a third embodiment of this invention.
Figure 4:
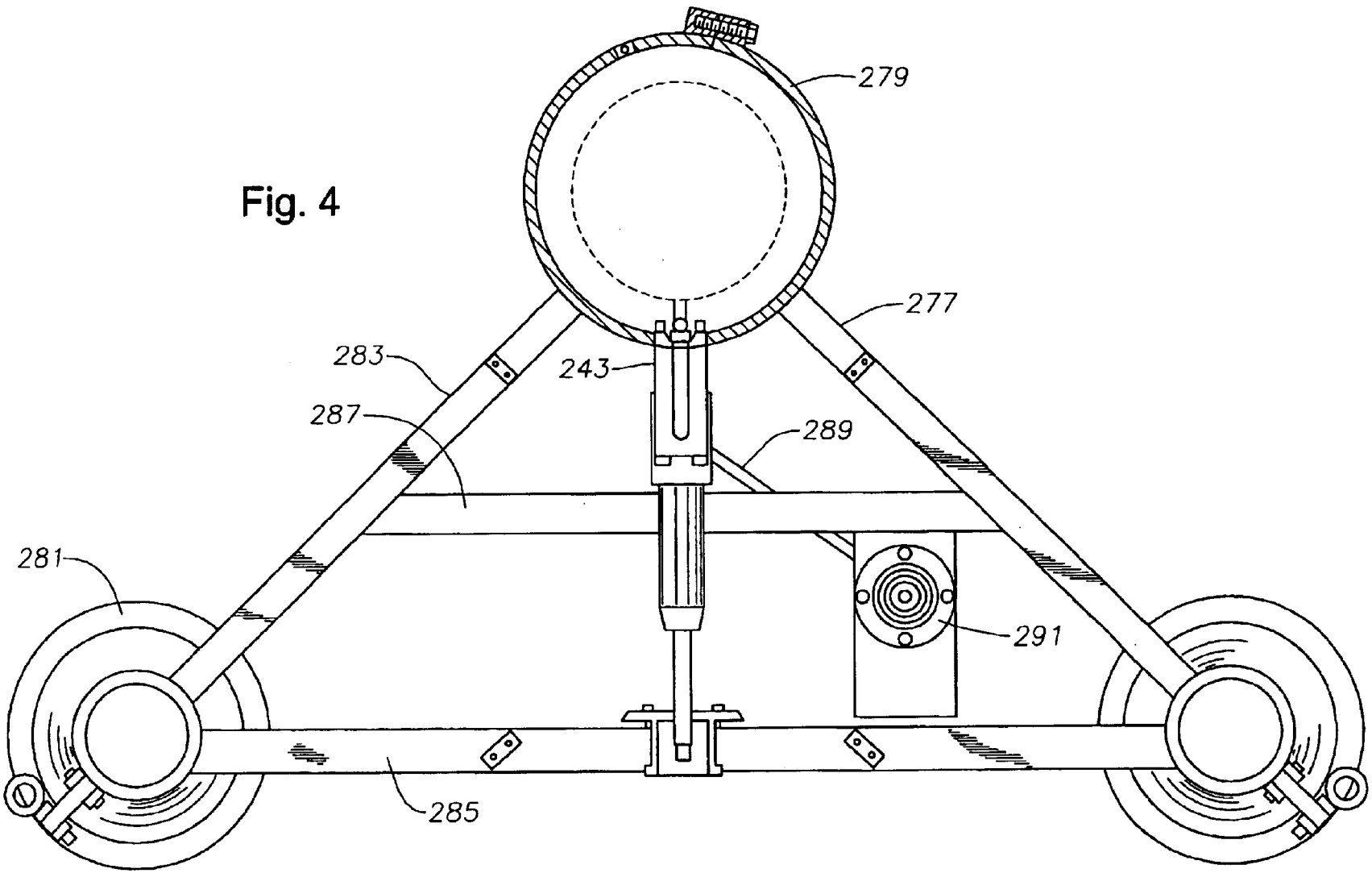
FIG. 4 is a topdown view of a guide frame built in accordance with the third embodiment of this invention.

FIGS. 3 and 4 show a third embodiment of the well assembly. Referring to FIG. 3, the guide base 271 that supports low pressure wellhead housing 211 is shown. Normally similar embodiments would also be employed in the first two embodiments. Guide base 271 has four upward extending posts 275 to help guide equipment when being landed on the well assembly. A guide frame 277 is attached to exterior surface 217 of high pressure wellhead housing 215. Preferably prior to running wellhead housing 215. Guide frame 277 attaches to high pressure housing 215 with a guide frame mounting ring 279, which connects around the circumference of high pressure housing 215. Two guide frame housing tubes 281 are attached to guide frame mounting ring 279 by guide frame extension rods 283. Guide frame housing tubes 281 are aligned so that guide frame tubes 281 can slide down two of the guide posts 275, therefore aligning high pressure wellhead housing 215 while landing in low pressure housing 211. A crossbar 285 connects guide frame housing tubes 281, which helps to provide structural stability to guide frame 277. A short guide frame crossbar 287 connects guide frame extension rods 283 is for additional guide frame 277 stability.

Casing annulus valve 243 is mounted to the outer surface of guide frame mounting ring 279. In this embodiment, valve 243 extends from mounting ring 279 to long guide frame crossbar 285 so that a remotely operated vehicle can easily reach valve 243 to open and close valve 243. An exterior tube 289 for communicating casing annulus pressure after passing through valve 243, extends away from valve 243 and connects to an upward facing connection 291 mounted to short guide frame crossbar 287.

Referring to FIG. 3, a production casing passageway 239 extends laterally through high pressure wellhead housing 215 from interior surface 219 towards exterior surface 217. Production passageway 239 begins above intermediate casing hanger packoff 229 and below production hanger casing packoff 233. Production passageway 239 connects with production casing valve 243, which is mounted to guide frame mounting ring 279. Production valve 243 prevents pressure communication of production casing annulus 237 while closed.

A tree assembly 255 having a downward facing connection 293 aligns and stabs into engagement with upward facing connection 291, while tree 255 lands on high pressure wellhead housing 215. Downward facing connection 293 and upward facing connection 291 connect so that the pressure of production casing annulus 237 communicates from production passageway 239, through extension tube 289 to tree assembly 255 for monitoring, when production valve 243 is open.

While the well assembly has been shown in three of its embodiments, it should be apparent to those skilled in the art that it is not so limited but is susceptible to various changes without departing from the scope of the invention.

What is claimed is:

1. A subsea well assembly comprising:

an outer housing having a conductor casing extending therefrom;

a wellhead housing landing in the outer housing and having a string of outer casing extending therefrom, the wellhead housing being a tubular member with an interior surface and an external surface;

at least one casing hanger landing in the wellhead housing, the casing hanger being secured to a string of inner casing, defining a casing annulus surrounding the inner casing;

a seal located around the upper portion of the casing hanger to sealingly connect the casing hanger with the interior surface of the wellhead housing; and a passageway for measuring the pressure of the casing annulus, the passageway having an inlet in the interior surface of the wellhead housing below the seal of the casing hanger and extending between the interior and external surfaces of the wellhead housing to a passageway outlet.

2. The subsea well assembly of claim 1, further providing that the passageway outlet is on the external surface of the wellhead housing.

3. The subsea well assembly of claim 1, further providing that the passageway outlet is on the external surface of the wellhead housing; wherein the subsea well assembly further comprises a valve in communication with the passageway outlet in order to control communication of casing annulus pressure; and a monitoring gauge in communication with the passageway outlet for monitoring the casing annulus pressure.

4. A subsea well assembly comprising:

a low pressure housing having a conductor casing extending therefrom;

a high pressure wellhead housing landing in the low pressure housing and having a string of outer casing extending therefrom;

at least one casing hanger landing in the high pressure wellhead housing which is secured to a string of inner casing, defining a casing annulus surrounding the inner casing;

a seal located around the upper portion of the casing hanger to sealingly connect the casing hanger with an interior wall of the high pressure wellhead housing; a passageway for measuring the pressure of the casing annulus, extending into the interior wall of the high pressure wellhead housing from below the seal of the casing hanger to a passageway outlet;

a monitoring gauge in communication with the passageway outlet of the passageway for monitoring the casing annulus pressure; wherein the passageway outlet is on an external surface of the high pressure wellhead housing;

a valve in communication with the passageway outlet in order to control the communication of the annulus pressure;

a tree assembly mounted above the high pressure wellhead housing for controlling production fluid; and a flying lead extending from the tree assembly and connected to the operable valve, the flying lead having a flexible tubing such that the tree assembly is in fluid communication with the passageway in the high pressure wellhead housing.

5. A subsea well assembly comprising:

a low pressure housing having a conductor casing extending therefrom;

a high pressure wellhead housing landing in the low pressure housing and having a string of outer casing extending therefrom;

at least one casing hanger landing in the high pressure wellhead housing which is secured to a string of inner casing, defining a casing annulus surrounding the inner casing;

a seal located around the upper portion of the casing hanger to sealingly connect the casing hanger with an interior wall of the high pressure wellhead housing;

a passageway for measuring the pressure of the casing annulus, extending into the interior wall of the high pressure wellhead housing from below the seal of the casing hanger to a passageway outlet;

a monitoring gauge in communication with the passageway outlet of the passageway for monitoring the casing annulus pressure; wherein the passageway outlet is on an external surface of the high pressure wellhead housing;

a valve in communication with the passageway outlet in order to control the communication of the annulus pressure;

an exterior tube connected to the valve, which leads to an upwardly facing connection; and a tree assembly mounted above the high pressure wellhead housing for controlling production fluid having a downwardly facing connection that matingly attaches to the upwardly facing connection when the tree assembly lands on the high pressure wellhead housing such that the tree assembly is in fluid communication with the passageway in the high pressure wellhead housing.

6. A subsea well assembly comprising:

an outer housing having a conductor casing extending therefrom;

a wellhead housing landing in the outer housing and having a string of outer casing extending therefrom, the wellhead housing being a tubular member with an interior surface and an external surface;

at least one casing hanger landing in the wellhead housing, the casing hanger being secured to a string of inner casing, defining a casing annulus surrounding the inner casing;

a seal located around the upper portion of the casing hanger to sealingly connect the casing hanger with the interior surface of the wellhead housing;

a passageway for measuring the pressure of the casing annulus, the passageway having an inlet in the interior surface of the wellhead housing below the seal of the casing hanger and extending between the interior and external surfaces of the wellhead housing to a passageway outlet; and wherein the outlet of the passageway is in the interior surface of the wellhead housing above the seal of the casing hanger.

7. The subsea well assembly of claim 6, further comprising:

a tree assembly that lands on the wellhead housing which has an isolation sleeve extending from the bottom of the tree into the wellhead housing, and sealingly connects to the interior surface of the wellhead housing above the casing hanger by an isolation sleeve seal.

8. A subsea well assembly comprising:

a low pressure housing having a conductor casing extending therefrom;

a high pressure wellhead housing landing in the low pressure housing and having a string of outer casing extending therefrom;

at least one casing hanger landing in the high pressure wellhead housing which is secured to a string of inner casing, defining a casing annulus surrounding the inner casing;

a seal located around the casing hanger to sealingly engage the casing hanger with an interior wall of the high pressure wellhead housing;

a passageway extending through a wall of the high pressure wellhead housing from below the seal of the casing hanger to an outlet on an external surface of the high pressure wellhead housing;

an operable valve in communication with the outlet on the exterior of the high pressure wellhead housing in order to control the communication of the annulus pressure;

a tree assembly mounted above the high pressure wellhead housing for controlling production fluid; and a flying lead extending from the tree assembly and connected to the operable valve, the flying lead having a flexible tubing such that the tree assembly is in fluid communication with the passageway in the high pressure wellhead housing for monitoring the casing annulus pressure.

9. The subsea well assembly of claim 8, further comprising:

an intermediate casing hanger landing in the high pressure wellhead housing and sealingly connected below the above mentioned casing hanger, which is secured to a string of intermediate casing and thereby defining an intermediate casing annulus surrounding the intermediate casing;

an intermediate seal located around the intermediate casing hanger to sealingly engage the intermediate casing hanger with the interior wall of the high pressure wellhead housing;

an intermediate passageway extending through the wall of the high pressure wellhead housing from below the intermediate casing hanger seal to an intermediate outlet on the external surface of the high pressure wellhead housing above the low pressure housing;

an intermediate valve in communication with the intermediate outlet on the exterior of the high pressure wellhead housing in order to control the communication of the intermediate annulus pressure;

and further providing that:

the flying lead is also connected to the intermediate valve, such that the tree assembly is in fluid communication with the intermediate passageway.

10. A subsea well assembly comprising:

a low pressure housing having a conductor casing extending therefrom;

a high pressure wellhead housing landing in the low pressure housing and having a string of outer casing extending therefrom;

at least one casing hanger landing in the high pressure wellhead housing which is secured to a string of inner casing, defining a casing annulus surrounding the inner casing;

a seal located around the casing hanger to sealingly connect the casing hanger with an interior wall of the high pressure wellhead housing;

a passageway for measuring the pressure of the casing annulus, extending through a wall of the high pressure wellhead housing from below the seal of the casing hanger to a passageway outlet located on an external surface of the high pressure wellhead housing;

an exterior tube connected to the outlet of the passageway, which leads to an upward facing connection; and a tree assembly having a downward facing connection that matingly attaches to the upward facing connection attached to the exterior tube such that the tree assembly is in fluid communication with the passageway in the high pressure wellhead housing, lands on the high pressure wellhead housing.

11. The subsea well assembly of claim 10, further comprising a valve for opening and closing the passageway to communicate the annulus pressure, which is attached to the exterior surface of the high pressure wellhead housing.

12. The subsea well assembly of claim 10, further comprising:

a guide base surround the low pressure housing, the guide base having at least two upward extending guide legs;

a guide frame that is attached to the high pressure wellhead housing, which has a housing tube that slides down each leg of the guide base; and where the upward facing connection is mounted to the guide frame.

13. A subsea well assembly comprising:

an outer housing having a conductor casing extending therefrom;

a wellhead housing landing in the outer housing and having a string of outer casing extending therefrom, the wellhead housing being a tubular wall with an interior surface and an external surface;

at least one casing hanger landing in the wellhead housing which is secured to a string of inner casing, defining a casing annulus surrounding the inner casing;

a casing hanger seal located around the casing hanger to sealingly connect the casing hanger with the interior surface of the wellhead housing;

a tree assembly that lands on the wellhead housing and which has an isolation sleeve extending from the bottom of the tree into the wellhead housing, and sealingly engages the interior surface of the wellhead housing above the casing hanger by an isolation sleeve seal; and a passageway for communicating with the casing annulus, extending within the wall of the wellhead housing between the interior and external surfaces, the passageway having a lower port formed in the interior surface of the wellhead housing end below the casing hanger seal and an upper port formed in the interior surface of the wellhead housing above the isolation sleeve seal.

14. A subsea well assembly comprising:

a low pressure housing having a conductor casing extending therefrom;

a high pressure wellhead housing landing in the low pressure housing and having a string of outer casing extending therefrom;

at least one casing hanger landing in the high pressure wellhead housing which is secured to a string of inner casing, defining a casing annulus surrounding the inner casing;

a casing hanger seal located around the casing hanger to sealingly connect the casing hanger with an interior wall of the high pressure wellhead housing;

a tree assembly that lands on the high pressure wellhead housing and which has an isolation sleeve extending from the bottom of the tree into the high pressure wellhead housing, and sealingly engages to the interior of the wellhead above the casing hanger by an isolation sleeve seal;

a passageway for measuring the pressure of the casing annulus, extending within a wall of the high pressure wellhead housing, having a lower inlet in and interior of the high pressure wellhead housing end below the casing hanger seal and an upper outlet in the interior of high pressure wellhead housing above the isolation sleeve seal;

an intermediate casing hanger landing in the high pressure wellhead housing and sealingly connected below the above mentioned casing hanger, which is secured to a string of intermediate casing and thereby defining an intermediate casing annulus surrounding the intermediate casing;

an intermediate seal located around the intermediate casing hanger to sealingly connect the intermediate casing hanger with the high pressure wellhead housing; and an intermediate passageway for measuring the pressure of the intermediate casing annulus, extending within wall a of the high pressure wellhead housing, having a lower inlet in the interior of the high pressure wellhead housing below the intermediate casing hanger seal and an upper outlet in the interior of the high pressure wellhead housing above the isolation sleeve seal.

15. A method of communicating with a casing annulus of a subsea well comprising:

(a) providing a well assembly comprising:

outer housing having a conductor extending therefrom;

a wellhead housing landing in the outer housing with a string of outer casing extending therefrom the wellhead housing being a tubular member with an interior surface and an external surface;

at least one casing hanger landing in the wellhead housing which is secured to a string of inner casing, defining a casing annulus surrounding the inner casing;

a seal located around the casing hanger to sealingly connect the casing hanger with the interior surface of the wellhead housing; and a passageway extending between the interior and external surfaces of the wellhead housing from having a lower port formed in the interior surface of the wellhead housing below the seal of the casing hanger to a passageway outlet;

(b) landing a tree assembly on the wellhead housing; and (c) communicating from the tree assembly with the casing annulus through the wellhead housing via the passageway.

16. The method of claim 15 wherein step (a) comprises locating the passageway outlet in the interior surface of the wellhead housing above the seal of the casing hanger.

17. The method of claim 15 wherein:

step (a) comprises locating the passageway outlet in the interior surface of the wellhead housing above the seal of the casing hanger; and step (b) comprises placing an isolation sleeve in the wellhead housing and sealing the isolation sleeve to the interior surface of the wellhead housing above the seal of the casing hanger below the outlet of the passageway.

18. A method of monitoring casing annulus pressure in a subsea well comprising:

(a) providing a well assembly comprising:

a low pressure housing having a conductor extending therefrom;

a high pressure well head housing landing in the low pressure housing with a string of outer casing extending therefrom;

at least one casing hanger landing in a bore of the high pressure wellhead housing which is secured to a string of inner casing, defining a casing annulus surrounding the inner casing;

a seal located around the upper portion of the casing hanger to sealingly connect the casing hanger with an interior wall of the of the high pressure wellhead housing; and a passageway extending into the interior wall of the high pressure wellhead housing from below the seal of the casing hanger to a passageway outlet;

(b) landing a tree assembly on the high pressure wellhead housing;

(c) communicating the production casing annulus pressure through the annulus surrounding the production casing, through the high pressure wellhead housing via the passageway, to the tree assembly for monitoring; wherein:

step (a) comprises locating the passageway outlet on an exterior of the high pressure wellhead housing;

step (b) further comprises attaching a flying lead to the tree; and step (c) comprises connecting the passageway outlet to the flying lead.

19. A method of monitoring casing annulus pressure in a subsea well comprising:

(a) providing a well assembly comprising:

a low pressure housing having a conductor extending therefrom;

a high pressure well head housing landing in the low pressure housing with a string of outer casing extending therefrom;

at least one casing hanger landing in a bore of the high pressure wellhead housing which is secured to a string of inner casing, defining a casing annulus surrounding the inner casing;

a seal located around the upper portion of the casing hanger to sealingly connect the casing hanger with an interior wall of the of the high pressure wellhead housing; and a passageway extending into the interior wall of the high pressure wellhead housing from below the seal of the casing hanger to a passageway outlet;

(b) landing a tree assembly on the high pressure wellhead housing;

(c) communicating the production casing annulus pressure through the annulus surrounding the production casing, through the high pressure wellhead housing via the passageway, to the tree assembly for monitoring; wherein:

step (a) comprises locating the passageway outlet on an exterior of the high pressure wellhead housing;

step (b) comprises connecting an upward facing connection to the passageway outlet;

step (b) further comprises attaching a downward facing connection to the tree; and step (c) comprises aligning with and stabbing the downward facing connection to the upward facing connection.

* * * * *

UNITED STATES PATENT AND TRADEMARK OFFICE

CERTIFICATE OF CORRECTION

PATENT NO. : 6,705,401 B2
DATED : March 16, 2004
INVENTOR(S) : Kevin G. Buckle et al.

It is certified that error appears in the above-identified patent and that said Letters Patent is hereby corrected as shown below:

Column 3,
Line 24, delete “The” and insert -- In the --
Line 32, delete “High” and insert -- The high --

Column 6,
Line 33, after “thus” insert -- are --

Column 11,
Line 20, delete the comma “,” after “housing” and insert -- when the tree --

Column 12,
Line 17, delete “end”
Line 31, insert -- a -- after “within”
Line 32, delete “a” before “of the high”
Line 40, insert -- an --before “outer housing”
Line 42, insert a comma -- , -- after “therefrom”
Line 53, delete “having”

Column 13,
Line 11, delete “well head” and insert -- wellhead --

Column 14,
Line 6, delete “well head” and insert -- wellhead --

Signed and Sealed this

Seventh Day of September, 2004

JON W. DUDAS
*Director of the United States Patent and Trademark Office*